US010345032B2

(12) United States Patent
Kang

(10) Patent No.: US 10,345,032 B2
(45) Date of Patent: Jul. 9, 2019

(54) REFRIGERATOR

(71) Applicant: LG Electronics Inc., Seoul (KR)

(72) Inventor: Daekil Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/810,316

(22) Filed: Nov. 13, 2017

(65) Prior Publication Data

US 2018/0135909 A1 May 17, 2018

(30) Foreign Application Priority Data

Nov. 11, 2016 (KR) ..... 10-2016-0150628

(51) Int. Cl.
*F25D 23/06* (2006.01)
*F25D 23/02* (2006.01)
*F25D 25/00* (2006.01)

(52) U.S. Cl.
CPC ..... *F25D 23/062* (2013.01); *F25D 23/021* (2013.01); *F25D 23/025* (2013.01); *F25D 23/069* (2013.01); *F25D 25/00* (2013.01)

(58) Field of Classification Search
CPC ..... F25D 23/02; F25D 23/021; F25D 23/025; F25D 23/04; F25D 23/12; F25D 23/062; F25D 23/069; F25D 25/00; F25D 2400/04
See application file for complete search history.

(56) References Cited

U.S. PATENT DOCUMENTS 2,235,454 A * 3/1941 Koropchak ..... F25D 23/025 160/37
8,333,446 B2 * 12/2012 Kang ..... F25D 23/025 312/291

(Continued)

FOREIGN PATENT DOCUMENTS

JP 2011085380 A 4/2011
KR 2009121030 A 11/2009

(Continued)

OTHER PUBLICATIONS

Korean Notice of Allowance in Korean Application No. 10-2016-0150628, dated Apr. 24, 2018, 3 pages.

(Continued)

*Primary Examiner* — Andrew M Roersma
(74) *Attorney, Agent, or Firm* — Fish & Richardson P.C.

(57) ABSTRACT

A refrigerator includes a cabinet, a partition wall partitioning the cabinet, an accommodating unit defining an accommodating space and an opening, where the accommodating space is recessed downward from a horizontal top surface of the partition wall, and the opening is located at an upper portion of the accommodating unit and configured to introduce food therethrough, an accommodating unit door located at the upper portion of the accommodating unit and configured to open and close the opening by moving in a direction parallel to the horizontal top surface, a roller located below the accommodating unit door, where the roller supports the accommodating unit door and allows the accommodating unit door to slidingly move with respect to the partition wall, and an upper rib provided at each of left and right portions of the accommodating unit door and configured to restrict splaying of the accommodating unit door.

24 Claims, 12 Drawing Sheets

(56) References Cited

U.S. PATENT DOCUMENTS

| | | | | |
|---|---|---|---|---|
| 2013/0127322 | A1* | 5/2013 | Seo | F25D 23/069<br>312/404 |
| 2015/0059399 | A1* | 3/2015 | Hwang | F25D 25/025<br>62/441 |
| 2015/0115790 | A1* | 4/2015 | Ogg | F25D 23/069<br>312/404 |
| 2015/0241117 | A1* | 8/2015 | Burke | F25D 23/065<br>312/404 |
| 2016/0282036 | A1* | 9/2016 | Lee | F25D 23/069 |

FOREIGN PATENT DOCUMENTS

| | | | | | |
|---|---|---|---|---|---|
| KR | 20090121030 | A | * 11/2009 | | F25D 25/024 |
| KR | 2011046237 | A | 5/2011 | | |
| KR | 2013055177 | A | 5/2013 | | |
| KR | 2015027979 | A | 3/2015 | | |
| WO | WO1995025254 | A | 9/1995 | | |
| WO | WO2010032557 | A | 3/2010 | | |
| WO | WO-2015131765 | A1 * | 9/2015 | | F25D 23/04 |
| WO | WO2016117942 | A | 7/2016 | | |

OTHER PUBLICATIONS

Extended European Search Report in European Application No. 17200458.2, dated Mar. 12, 2018, 10 pages.

* cited by examiner

REFRIGERATOR

CROSS REFERENCE TO RELATED APPLICATIONS

Pursuant to 35 U.S.C. § 119(a), this application claims the benefit of earlier filing date and right of priority to Korean Application No. 10-2016-0150628, filed on Nov. 11, 2016, the contents of which are hereby incorporated by reference herein in their entirety.

FIELD

The present disclosure relates to a refrigerator, more particularly, to a storage unit for efficiently utilizing a space where refrigerating or freezing objects are stored and to a door for opening/closing the storage unit.

BACKGROUND

A refrigerator is an electric appliance configured to refrigerate or freeze stored goods in a storage space (e.g., refrigerate objects or freeze objects) through a cycle for compressing, condensing, expanding and evaporating refrigerant. For example, a refrigerator is an electric appliance including a storage space and a heat exchanger for absorbing heat from internal air of the storage space, so as to keep the temperature of the stored goods stored in the storage space below a room temperature.

A volume of the storage space may be limited by a storage capacity preset in the refrigerator and it is one of important issues to consider to efficiently utilize the storage space when designing a refrigerator.

For an efficient use of the storage space, a predetermined space for accommodating stored goods may be provided in the refrigerator, and a drawer retractable from the storage space or a rack for supporting stored goods may be provided.

Considering the volumes of the stored goods, the storage space provided in the refrigerator may be partitioned by a drawer and a rack. Accordingly, the number or volume of the storage units (e.g., the rack or drawers) installable in the storage space, of which maximum volume is set according to the capacity of the refrigerator, may be limited.

In some examples, to add a new storage device to the storage space of the refrigerator, some of the drawers or racks or the volume of the drawer or a gap between the racks or the rack and the drawer may need to be reduced. In some case, some of the storage space has to be used as the space for installing a new storage device or unit.

In some examples, if the design is changed to reduce the volume or number of the drawers or racks to install a new storage device, a storage space intended to store goods therein in design may fail to store the goods and efficiency of the storage space might be rather deteriorated.

In some cases, such design change (e.g., reducing the volume or number of the drawers or racks) is not much different from designing new the storage space. Accordingly, it may be difficult to add a new storage device or unit to the refrigerator while keeping the preset volume of the storage space.

In some examples, a storage device door may be provided in the storage device to partition an internal space of the storage compartment into several spaces. The door may be provided to selectively open the storage device. However, it may require room for opening and closing of the door. For example, the space required for the door to move might also cause another problem of the reduced storage space.

SUMMARY

The present disclosure may solve the noted disadvantages and problems.

According to one aspect of the subject matter described in this application, a refrigerator includes a cabinet defining a first storage compartment and a second storage compartment vertically below the first storage compartment, a partition wall partitioning the cabinet into the first storage compartment and the second storage compartment and having a horizontal top surface, an accommodating unit defining an accommodating space and an opening in which the accommodating space is recessed downward from the horizontal top surface of the partition wall, and the opening is located at an upper portion of the accommodating unit and being configured to introduce food therethrough, an accommodating unit door located at the upper portion of the accommodating unit and configured to open and close the opening by moving in a direction parallel to the horizontal top surface of the partition wall, a roller located below the accommodating unit door where the roller supports the accommodating unit door and allows the accommodating unit door to slidingly move with respect to the partition wall, and an upper rib provided at each of left and right portions of the accommodating unit door and configured to restrict splaying of the accommodating unit door.

Implementations according to this aspect may include one or more of the following features. For example, the upper rib may be located in the partition wall and spaced apart from a lateral side surface and a top surface of the accommodating unit door. A length of the upper rib may be shorter than a side length of the accommodating unit door. The accommodating unit door has a rectangular plate shape including straight sides and round corners. The accommodating unit door may include transition portions between the straight sides and the round corners, respectively, and the upper rib may be configured to cover at least one of the transition portions based on the accommodating unit door closing the opening.

In some implementations, the partition wall may include a rail rib that protrudes upward and that contacts and supports the roller. In some examples, the refrigerator may further include a guide rib extending downward from left and right portions of the roller and surrounding both sides of the rail rib. The rail rib may be spaced apart from the guide rib by a predetermined distance in a width direction, and the predetermined distance is less than a distance between the lateral side surface of the accommodating unit door and the upper rib in the width direction.

In some examples, the roller may include a first pair of rollers located at the left portion of the accommodating unit door and a second pair of rollers located at the right portion of the accommodating unit door, and the guide rib includes a first pair of guide ribs located at the left portion of the accommodating unit door and a second pair of guide ribs located at the right portion of the accommodating unit door. In some examples, the refrigerator may further include a transfer unit located at the partition wall, the transfer unit including an elastic portion configured to provide elasticity to the accommodating unit door based on the accommodating unit door moving to open the opening of the accommodating unit.

In some implementations, the transfer unit may further include a speed control portion configured to decelerate movement of the accommodating unit door based on the accommodating unit door moving to close the opening of the accommodating unit. In some examples, the transfer unit may further include a transfer unit body being coupled to the partition wall and defining a transfer space extending in a direction parallel to movement of the accommodating unit door, and a slider movably provided in the transfer space and coupled to the accommodating unit door. The elastic portion may include a first end connected to the transfer unit body and a second end connected to the slider. In some examples, the transfer unit may be located rearward of a center portion of the accommodating unit door.

In some implementations, the refrigerator may further include a transfer unit accommodating groove that is defined at the top surface of the partition wall and that receives the transfer unit, and a cover that is located vertically above the transfer unit accommodating groove and that protects the transfer unit accommodating groove from foreign substances. The cover may be configured to move together with the accommodating unit door in rearward and forward directions. The cover may be coupled to the slider and configured to move together with the slider based on the accommodating unit door moving forward to close the opening. In some examples, the cover may be fixed to the partition wall and allows relative movement of the accommodating unit door with respect to the cover.

In some implementations, the cover may include a pair of coupling portions located at rear left and right portions of the cover, respectively, and an open portion located forward of the pair of coupling portions and configured to receive the accommodating unit door between the partition wall and a lower surface of the cover based on the accommodating unit door moving rearward to open the opening. In some examples, the cover may slope upward with respect to the top horizontal surface of the partition wall toward a front portion of the cover, and a distance between the top horizontal surface of the partition wall and the lower surface of the cover is greater at the front portion of the cover than at a rear portion of the cover.

In some examples, the accommodating unit door may include an upper surface configured to slidingly contact the lower surface of the cover based on the accommodating unit door moving toward a rear portion of the cover. The upper surface of the accommodating unit door may slope upward toward the rear portion of the cover with respect to the top horizontal surface of the partition wall.

As briefly described above, the upper rib may be provided to cover a portion of a lateral surface of the door where a linear region meets the rounds, in a state where the accommodating unit door is closed. In a state where the door is completely open and closed, the upper rib may be located to partially cover the round (a region where a linear portion of the door lateral surface meets the upper rib). Accordingly, the door opening and closing may be performed smoothly in an initial stage.

The refrigerator may further comprise a guide rib extended downwardly from left and right portions of the roller and surrounding both sides of the rail rib.

A left-and-right gap may be formed between the rail rib and the guide rib, and the left-and-right gap may be smaller than a left-and-right gap between a lateral surface of the door and the upper rib.

In the normal door movement in which the movement in a state where the left and right portions of door are not twisted or deformed, the guide rib and the rail rib may not contact with each other. However, if the left and right twisting of the door occurs, the guide rib contacts with the rail rib so that no further door twisting is generated and the contact between the door and the upper rib may be prevented.

Two rollers and two guide ribs may be vertically formed in a left portion of the door, and two rollers and two guide ribs may be vertically formed in a right portion of the door. Accordingly, the door twisting or deformation may be generated stably and effectively. Even if the door is twisted or deformed on the horizontal surface in any directions, contact is generated in all of the four front and rear and left and right points so as to prevent further twisting effectively.

Accordingly, the door is inserted in the lower portion of the cover as the door is open and the inserted length increases. As the door closes, the door gets out of the cover. In a state of being completely closed, the door is located in the front portion of the cover and located out of the cover. That is because the door can be easily decoupled from the connector in a state of being completely out of the cover.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

In some implementations, the storage device may be capable of minimizing the volume of the space required for installation and a refrigerator including the storage device. The storage device may include a partition wall for dividing a storage space and then capable of adding an auxiliary storage space, without occupying a preset space for accommodating stored goods, and a refrigerator including the storage device. The refrigerator may be capable of improving facilitation of a door for opening/closing a storage device and minimizing the decrease of the storage space by minimizing the space required in manipulation of the door.

In some implementations, the storage device may be capable of opening/closing an opening thereof by providing a door with a restitution force and decelerating the speed of the door, when the door passes a specific point of the opening, and a refrigerator including the storage device. The storage device may be capable of preventing foreign substances from entering a transfer unit for operating a door for opening/closing an opening formed in the storage device and a refrigerator including the storage device. The storage device may include a guider for guiding movement of a door so as to operate the door for opening/closing an opening thereof stably and a refrigerator including the storage device.

In some implementations, the refrigerator may be easy to use by providing a door movable back and force in a horizontal direction to open and close a storage device. In some examples, the refrigerator provides a beautiful design by locating the components for guiding or supporting the movement of the door in a rear portion and/or both edge portions of the door. The refrigerator may include a storage device which is recessed in a vertical direction and a storage device door which is movable in an upper portion of the storage device in a horizontal direction to open and close the storage device.

In some implementations, the refrigerator may include a vertically-movable storage device door which is capable of moving stably and smoothly even if a force is applied to the door in a vertical direction or a horizontal direction eccentric aside from a right-and-left center. In some implementations, the refrigerator may include a storage device which is capable of improving reliability and durability by including a transfer unit for stably moving a storage device door and a transfer unit cover body for protecting the transfer unit. In some examples, the refrigerator may include a storage device which is capable of preventing splay of a horizontally-movable plate-shaped accommodating unit door and moving back and forth stably.

In some examples, the refrigerator may be capable of minimizing horizontal distortion of a plate-shaped accommodating unit door and noticeably reducing the friction applied to the accommodating unit door. In some examples, the refrigerator may include a storage device of which a transfer unit cover body is fixed in narrow circumferences of a storage compartment and of which a storage device door is smoothly inserted in the transfer unit cover when the door is open.

BRIEF DESCRIPTION OF THE DRAWINGS

The present disclosure will become more fully understood from the detailed description given herein below and the accompanying drawings, which are given by illustration only, and thus are not limitative of the present disclosure.

DETAILED DESCRIPTION

Description of a refrigerator will now be given in detail according to exemplary implementations disclosed herein, with reference to the accompanying drawings.

Use of such terminology for structures and control methods herein is merely intended to facilitate description of the specification, and the terminology itself is not intended to give any special meaning or function. In the present disclosure, that which is well-known to one of ordinary skill in the relevant art has generally been omitted for the sake of brevity.

The disclosed subject matter may, however, be implemented in many different forms and should not be construed as limited to the exemplary implementations set forth herein. Rather, the exemplary implementations are provided so that this disclosure is thorough and complete, and will convey the scope of the disclosed subject matter to those skilled in the art.

Figure 1:
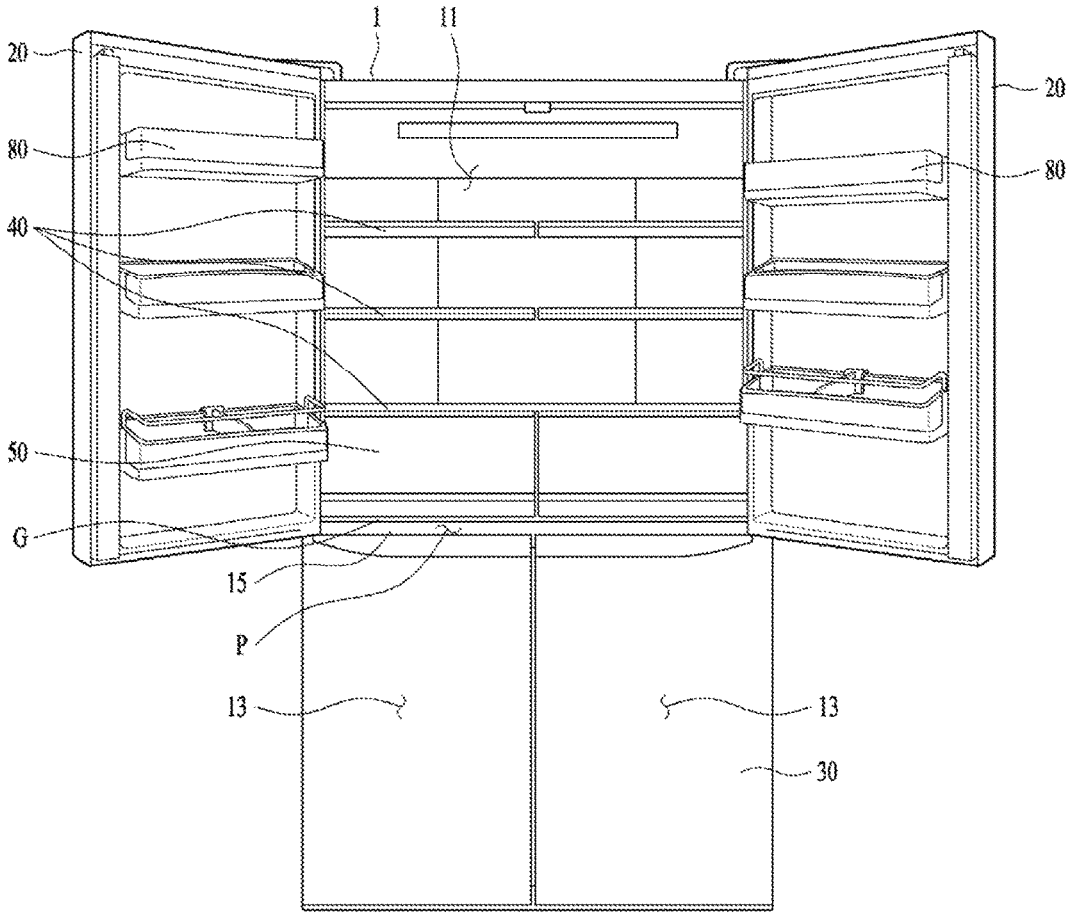
FIG. 1 illustrates an example refrigerator.

FIG. 1 illustrates an example refrigerator. The refrigerator may be applicable to a top mount type refrigerator having a freezer compartment mounted in a top of a refrigerator compartment and a side by side type refrigerator having the freezer compartment and the refrigerator compartment mounted side by side. The present disclosure may be applied to a bottom freezer type refrigerator having the freezer compartment mounted in a bottom portion under the refrigerator compartment.

The refrigerator may include a case or a cabinet for defining an overall exterior of the refrigerator viewed from an outside, and a storage compartment 11 and 13 provided in the cabinet to store foods therein.

A refrigerator door 20 and 30 may be provided in the refrigerator to open and close the storage compartment. For example, the refrigerator door may include a freezer door 30 and a refrigerator door 20 that are rotatably coupled to the cabinet 1 of the refrigerator by a hinge. The freezer door 30 and the refrigerator door 20 may be configured of a plurality of doors, respectively. As shown in FIG. 1, the refrigerator door 20 and the freezer door 30 may be coupled to both side edges of the refrigerator to be open forward.

The storage compartment 11 and 13 defines a heat-insulated space by the cabinet 1 and the refrigerator door 20 and 30. When the refrigerator door 20 and 30 closes the storage compartment 11 and 13 airtight, the heat-insulated space partitioned off from the outside may be formed. For example, the storage compartment 11 and 13 may be the space partitioned off from the outside via the heat-insulation wall by the heat-insulation wall of the door and the heat-insulation wall of the cabinet 1.

The cold air suppled from a mechanical chamber is able to circulate in any spots of the storage compartment 11 and 13, so as to preserve the foods stored in the storage compartment at low temperatures. In the present implementation, the storage compartment located in a top portion may be a first storage compartment. For example, the first storage compartment may be the refrigerator compartment. A bottom storage compartment may be a second storage compartment. For example, the second storage compartment may be the freezer compartment. The first storage compartment provided as one storage compartment may be open and closed by left and right doors 30 and the second storage compartment may be divided into two left and right spaces and the two spaces may be open and closed by left and right refrigerator doors 30, respectively.

A barrier or partition wall 15 may be provided in a bottom of the storage compartment 11. For example, a partition wall 15 may be installed in a lower end of the storage compartment 11 to partition off the internal space into the freezer compartment and the refrigerator compartment. The partition wall 15 may be extended horizontally, with a predetermined thickness.

A rack 40 may be provided in the storage compartment 11. In some examples, a plurality of racks 40 may be provided and foods are able to be stored on them. The racks 40 may partition off the internal space of the storage compartment in a horizontal direction.

A retractable drawer 50 may be installed in the storage compartment 11 and foods and the like may be stored in the drawer 50. Two drawers 50 may be arranged in the storage compartment 11 side by side. A user may open a left door of the storage compartment 11 to access one drawer arranged in a left portion and a right door of the storage compartment 11 to access the other drawer arranged in a right portion.

A predetermined space may be formed in the partition wall 15 to accommodate the foods and the space may be referred to as a multi-storage compartment or a storage device P. The partition wall 15 is provided as an independent member from the refrigerator door 20 and 30 and it maintains a fixed state without moving according to the rotation of the refrigerator door 20 and 30, so that the user can store or take out foods stably, using the storage device P.

The internal space of the storage compartment 11 maybe partitioned off into a plurality of spaces including upper spaces of the racks 40, a space defined by the drawer 50 and the storage device P formed in the partition wall 15, in which foods are stored.

The storage device P is recessed from the partition wall 15 provided as a bottom surface of the storage compartment 11 downwardly. For example, a predetermined height of the partition wall 15 is reduced enough to form the storage device P. Accordingly, the volume of the storage compartment 11 may be more expanded by the storage device P.

In some examples, each of the spaces may be employed as a storage space which is arranged in one storage compartment 11 and the cold air supplied to the storage compartment 11 is able to move into the spaces. In some examples, the spaces are partitioned to allow the cold air to move thereto so that they may have a different meaning from the storage compartment mentioned above. In some examples, the spaces may have temperature differences within one storage compartment, not forming the heat-insulated spaces, different from the storage compartment forming the heat-insulated space. The cold air supplied to one storage compartment may freely move not to another storage compartment but to each of the spaces divided in one storage compartment. For example, the cold air of the upper spaces with respect to the racks 40 is movable to the space formed by the drawer 50. In some cases, a plurality of baskets 80 may be provided in the refrigerator door 20 and the baskets 80 may be arranged with different heights to receive the foods.

In some examples, a gap G is formed between the top surface of the partition wall 15, that is, a bottom surface of the storage compartment and the auxiliary storage space such as the drawer 50. The gap G is provided to secure a movement space for an accommodating unit door for opening/closing an accommodating unit 4 which will be described later. Accordingly, the gap G may be formed corresponding to the height of the horizontal-plate-shaped accommodating unit. In some examples, the gap G has a predetermined height enough to facilitate smooth movement of the accommodating unit door and the space recessed from the partition wall 15 is used so that the volume of the storage compartment can be increased. The horizontal-plate shaped accommodating unit door is horizontally movable so as to reduce the decrease of the storage space in the storage compartment caused by the accommodating unit door.

Hereinafter, an example storage device P will be described in detail.

Figure 2:
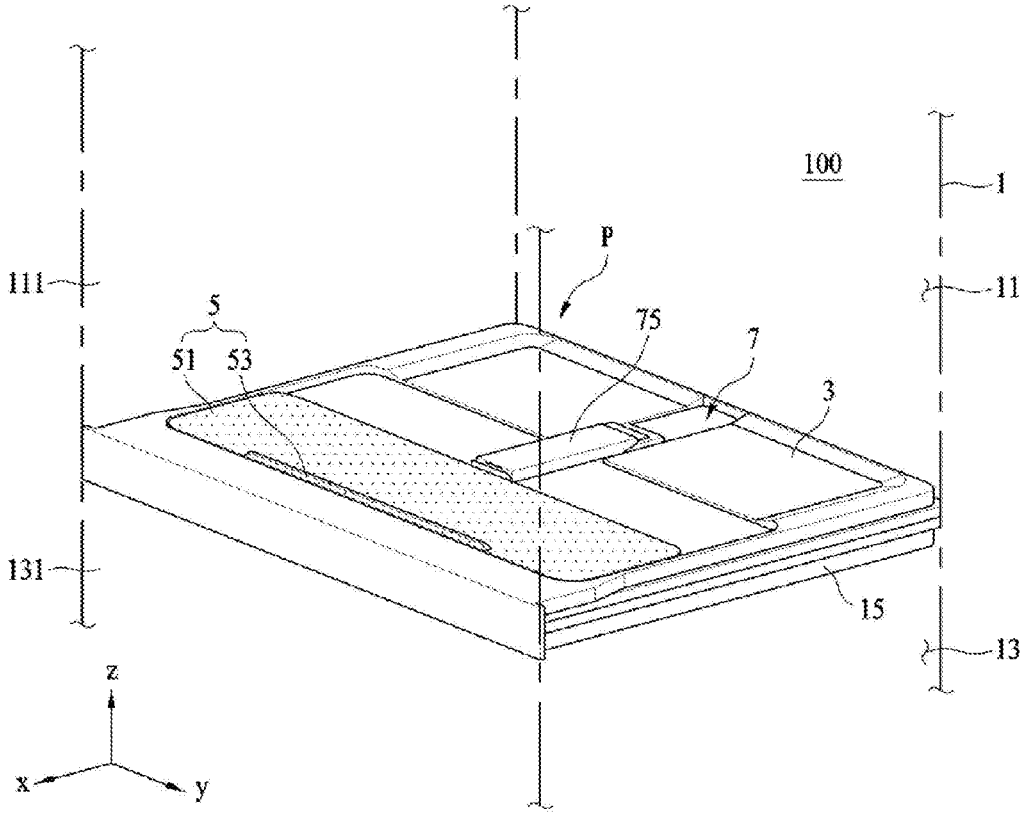
FIG. 2 is a perspective view illustrating an example storage device shown in FIG. 1 and showing a state where an example accommodating unit door is closed.
Figure 3:
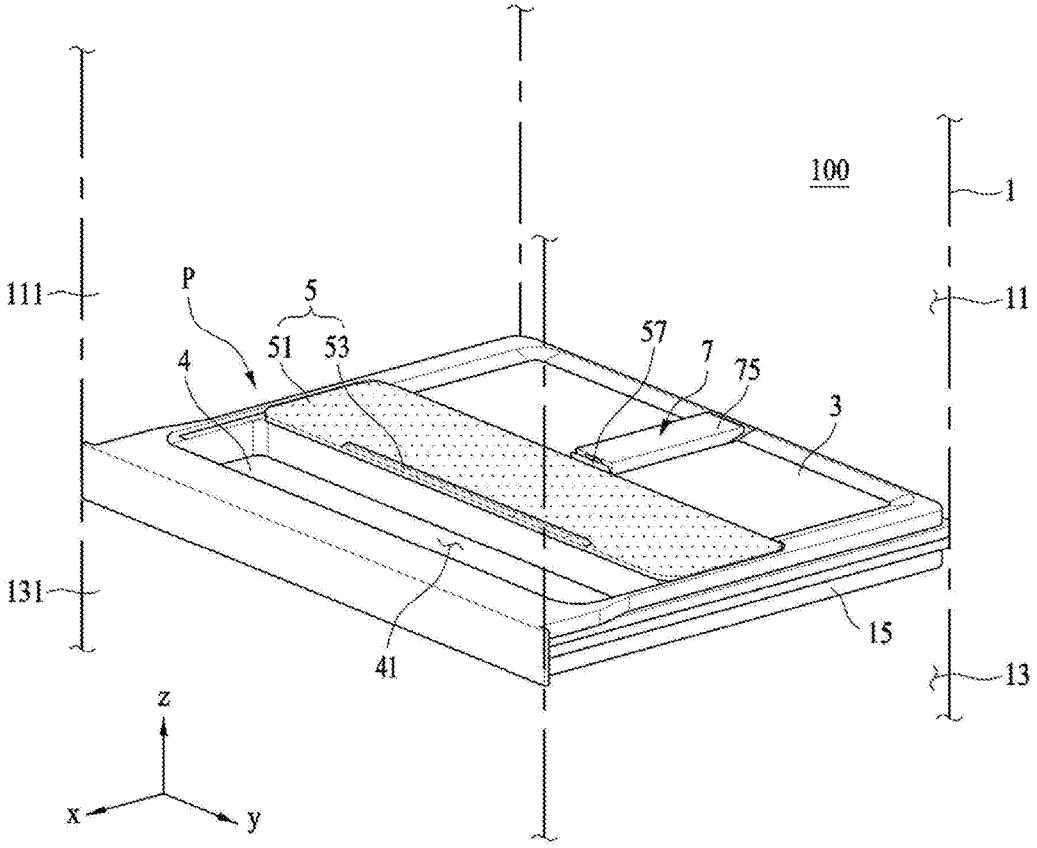
FIG. 3 is a perspective view illustrating the storage device shown in FIG. 1 and showing a state where the accommodating unit door is open.

As shown in FIGS. 2 and 3, the refrigerator 100 may include the cabinet 1, the storage compartment 11 and 13 provided in the cabinet 1 and defining a predetermined space for accommodating stored goods (refrigerating objects or freezing objects), and a heat exchanger for exchanging heat with internal air of the storage compartment.

A plurality of storage compartments may be provided in the cabinet 1. FIGS. 2 and 3 show that the storage compartment is divided into a first storage compartment 11 and a second storage compartment 13 as one example.

When the storage compartment is divided into the first storage compartment 11 and the second storage compartment 13, the first storage compartment may be employed as the freezer compartment or the refrigerator compartment and the second storage compartment 13 as the other compartment. In some examples, the first storage compartment 11 and the second storage compartment 13 may be distinguished by the partition wall 15.

In some examples, the first storage compartment 11 and the second storage compartment 13 may be provided as spaces which are partition off from one refrigerator or freezer compartment by the partition wall 15.

The storage compartments 11 and 13 have to have an open surface for the user to take the stored goods out of the cabinet 1. For example, the first storage compartment 11 may be in communication with the outside of the cabinet 1 via a first open surface or a first opening 111 and the second storage compartment 13 may be in communication with the outside via a second open surface or a second opening 131.

The first opening 111 and the second opening 131 may be open and closed by the refrigerator door 20 and 30.

However, in case the first storage compartment 11 and the second storage compartment 13 are divided in one refrigerator or freezer compartment, one door may open and close them simultaneously.

The heat exchanger may include a compressor for compressing a refrigerant, a condenser for condensing the refrigerant after exchanging heat with external air of the cabinet, an expansion valve for lowering the pressure of the refrigerant exhausted from the condenser, and an evaporator for evaporating the refrigerant having exchanged heat with air inside the storage compartment 11 and 13. The evaporator is configured to absorb heat from the air inside the storage compartment so that the air inside the storage compartment can be chilled while passing the evaporator. Through the process, the heat exchanger is capable of controlling the temperatures of first and second storage compartments 11 and 13 to be below room temperature.

The storage device P is provided in the partition wall 15 configured to partition off the internal space into the first storage compartment 11 as the first space and the second storage compartment 13 as the second space. The storage device P may include an accommodating unit 4 recessed from the partition wall 15 downwardly and providing a space for accommodating the stored goods, and an accommodating unit door 5 provided to move along a direction parallel with the top surface of the partition wall 15.

The accommodating unit 4 may be formed in the partition wall 15 or it may be formed via an accommodating unit body 3 coupled to the partition wall 15. In case the accommodating unit body 3 is coupled to the top of the partition wall 15, the accommodating unit body 3 may be made of a material which is different from the material of the partition wall 15. For example, the accommodating unit body 3 is made of stainless steel and formed in a container shape. The container shape may define the accommodating unit 4.

For example, any structure configured to partition off the internal space of the storage compartment, with a predetermined thickness (a length in a longitudinal direction of the cabinet and a length in Z-axis direction) may be implemented as the partition wall 15. A predetermined portion of the partition wall 15 which is recessed to have a reduced thickness may be the accommodating unit 4 as the storage compartment.

When the first storage compartment 11 is provided as the refrigerator or freezer compartment and the second storage compartment 13 as the other compartment, the partition wall 15 may include a heat-insulating portion and the accommodating unit body 3 may define the top surface of the partition wall 15.

However, when the first and second storage compartments 11 and 13 are the spaces divided in one refrigerator or freezer compartment, it is not necessary to form the heat insulation portion in the partition wall 15 and the accommodating unit body 3 becomes the partition wall 15.

Hereinafter, the accommodating unit body 3 defining the top surface of the partition wall 15 will be described.

As shown in FIGS. 2 and 3, the accommodating unit 4 is the space formed by concavely bending or recessing the surface of the accommodating unit body 3 and the stored goods can be introduced into the accommodating unit 4 via an opening 41 formed in a top surface of the accommodating unit 4. In some examples, the accommodating unit 4 is located in a front surface of the unit body 3 which is toward a cabinet door, in other words, forwardly in the bottom surface of the first storage compartment 11.

In case the storage device P of the present implementation is provided in the partition wall 15, auxiliary components such as the rack 40 or the drawer 50 mentioned above may be provided over the storage device P. when a gap between the storage device P and the auxiliary device is narrow, the accommodating unit 4 has to be located in a front portion of the first storage compartment 11 so that the user can put or take stored goods in or from the accommodating unit 4 easily.

For example, the rack 40 or the drawer 50 is provided not right above the storage device P but above a rear portion of the storage device P. A gap G may be formed between the rack 40 or the drawer 50 and the storage device P.

The accommodating unit 4 may be provided as an accommodating groove integrally formed with the accommodating unit body 3 or configured of the accommodating groove and a tray detachably coupled to the accommodating groove.

When decided to wash the accommodating unit 4 configured of the accommodating groove and the tray, the user detach and take out the tray via the opening 41 to wash the tray. When decided to wash the accommodating unit 4 configured of only the accommodating groove, the user is able to wash the accommodating unit 4 more easily.

In some examples, when the accommodating unit body 3 defines the top surface of the partition wall 15, the accommodating unit 4 is embedded in the partition wall 15 and requires no additional space for the accommodating unit 4.

In some examples, the accommodating unit body 3 defines the top surface of the partition wall 15 and the accommodating unit 4 is located in the partition wall 15. In some examples, the storage device P as illustrated may be installed in the storage compartment 11, without decreasing the storage compartment 11 and 13 with the limited volume. Briefly, the overall volume of the storage compartment may be expanded.

The fact that the accommodating unit 4 can be installed without occupying the volume of the storage compartment 11 and 13 may mean that the space for accommodating the stored goods can be added without changing the volume of the devices installed in the storage compartment 11 and 13 such as the drawer, the rack and the like for the stored goods. When the unit body 3 forms the top surface of the partition wall 15 in which the storage device is provided, the volume of the space required to install the storage device P may be minimized.

As shown in FIGS. 2 and 3, the accommodating unit door 5 is configured to open and close the opening 41 located in the accommodating unit, and may include a door body 51 which is movable along a surface of the accommodating unit body 3. A handle 53 may be provided in the door body 51 to facilitate the operation of the door body 51.

The accommodating unit 4 is recessed downwardly and the opening 41 is formed in a top surface of the accommodating unit. The introduction of the foods via the opening 41 is performed vertically. A door for opening and closing the opening 41 may be provided in a horizontal direction. Accordingly, the direction of introducing the foods and the moving direction of the accommodating unit door 5 may be perpendicular to each other.

In some implementations, the drawer 50 for storing the foods, which is retractable from the storage compartment to accommodate the stored foods. or the racks 40, which are fixedly mounted in the storage compartment and support the stored goods, are provided in the storage compartment 11 and 13 of the refrigerator along a height direction of the storage compartment.

Accordingly, the drawer or rack may be provided over the storage device P mentioned above. If the door 5 is rotatably coupled to the accommodating door body 51 toward the drawer or rack located over the door 5, a distance between the storage device P and the drawer or the rack has to be longer than a rotational radius for the user to introduce or take out the foods from the accommodating unit 4.

If it is necessary to change the height of the rack or drawer to install the storage device P, it may mean that the storage space is eaten up. The opening 41 of the storage device P is open by the door body 51 which is movable along a direction parallel with the surface of the unit body 3 so as to minimize the volume of the space required to install the storage device P.

As shown in FIGS. 2 and 3, the storage device P may include a transfer unit 7. The transfer unit 7 may function to guide the movement of the door 5 and also keep an open state of the door 5. In addition, the transfer unit 7 may function to adjust the speed of the moving door 5. For example, the transfer unit 7 may perform a function of automatically providing a force applied to close the door 5.

Hereinafter, referring to FIGS. 4 through 8, an example structure of the storage device P will be described in detail.

Figure 4:
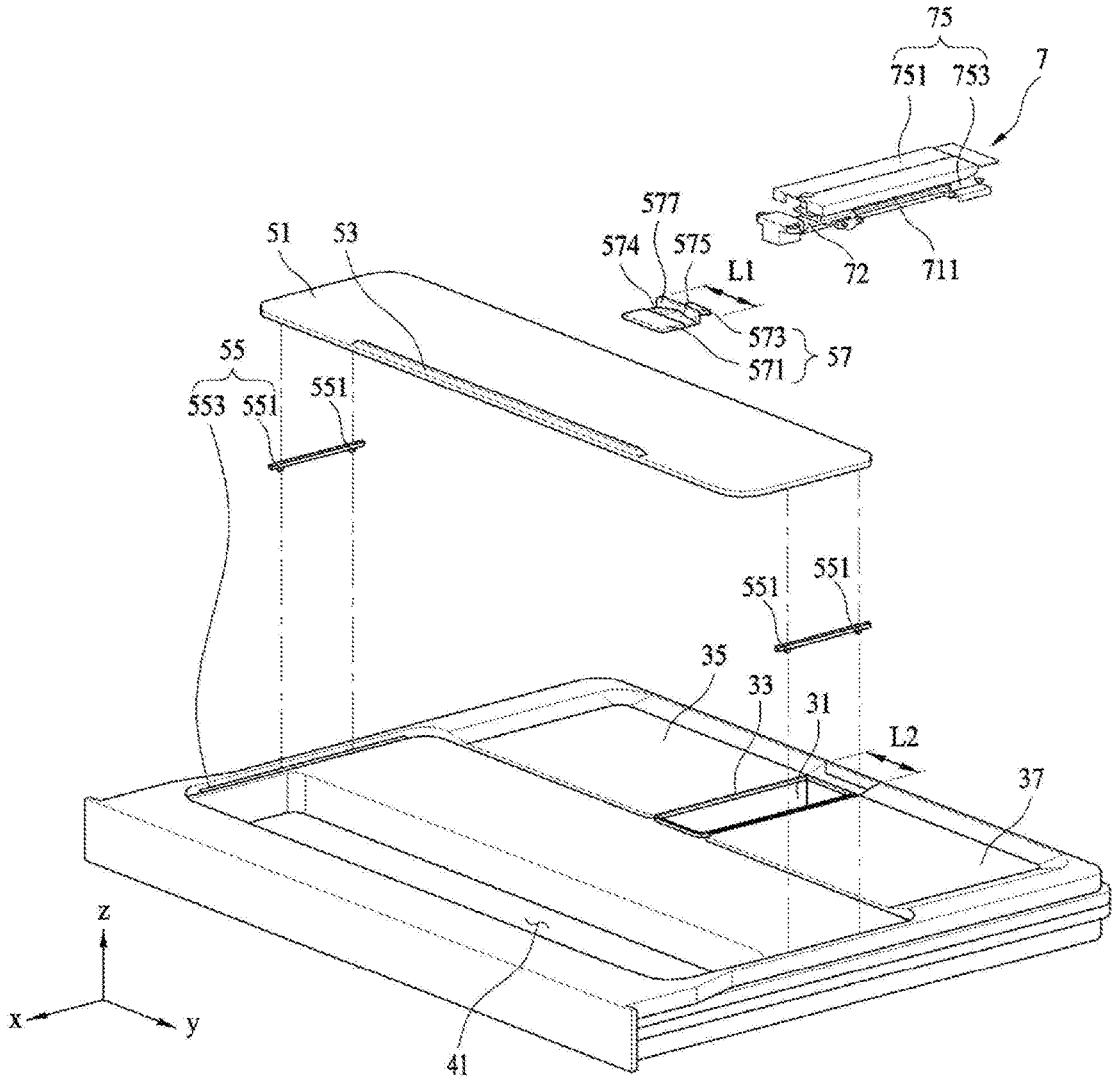
FIG. 4 is an exploded perspective view showing the storage device shown in FIG.

As shown in FIG. 4, the illustrated implementation may further include the transfer unit 7 configured to adjust the speed of the moving door body 51 and provide the door with a restitution force to return the door body 51 to an initial location as shown in FIG. 2 when the door body 51 opens the opening 41.

To install the storage device P without eating up the storage space of the storage compartment 11 and 13, in some examples, the transfer unit 7 is provided in a transfer unit accommodating groove 31 formed by concavely bending the accommodating unit body 3 toward the second storage compartment 13. The transfer unit accommodating groove 31 is provided along a movement direction of the door body 51 (a direction along the depth of the first space, an X-axis direction).

The door body 51 is connected to the transfer unit 7 via a connector 57. As shown in FIG. 4, the connector 57 may include a connector body 571 fixed to the door body 51, and a slider coupling portion 573 provided in the connector body 571 to be coupled to the transfer unit 7.

Figure 5:
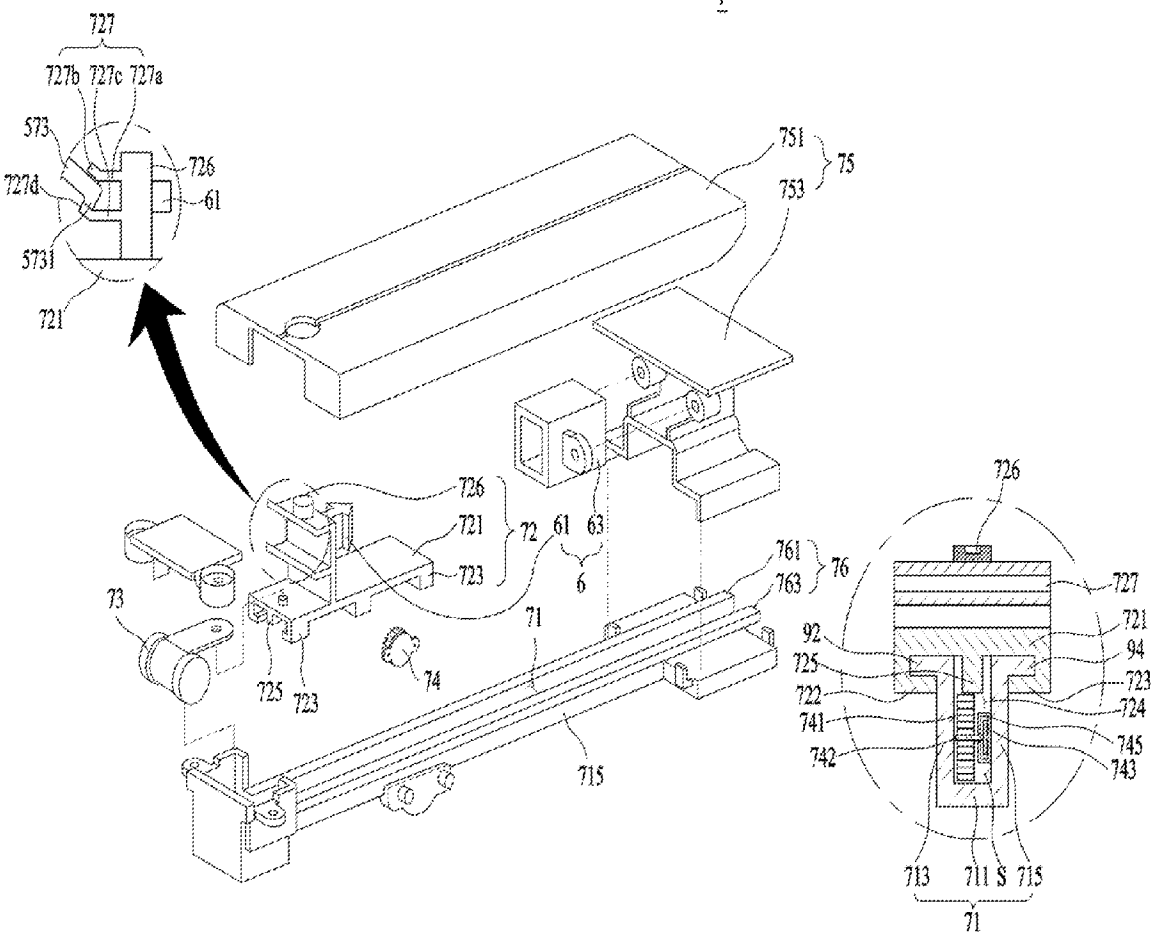
FIG. 5 is an exploded perspective view and a cross-sectional view illustrating an example transfer unit provided in the storage device.

As shown in FIG. 5, the transfer unit 7 may include a transfer unit body 71 provided in the transfer unit accommodating groove 31, a transfer space (S) provided in the transfer unit body 71 along a direction parallel with the moving direction of the door body 51, a slider 72 movable along the transfer space, and an elastic portion 73 for supplying a restitution force to the door body 51. The transfer unit 7 may further include a speed control portion 74 for decelerating the door body 51 when the door body 51 moves in a direction to close the opening 41.

The transfer space (S) may be defined by a base 711 fixed to the transfer unit accommodating groove 31 and a first lateral wall 713 and a second lateral wall 715 which are provided in both opposite surfaces of the base 711 in parallel with the door body 51.

The slider 72 includes a slider body 721 reciprocating along the transfer space (S), and a door coupling portion 727 for coupling the slider body 721 and the slider coupling portion 573 to each other.

The slider body 721 is coupled to a slider guider 92 and 94 provided in the transfer unit body 71 via a first coupling and a second coupling portion 723. The slider guider may include a first guider 92 provided in the first lateral wall 713 and a second guider 94 extended from the second lateral wall 715. The first guider 92 is projected toward a direction which gets farther from the transfer space (S) and the second guider 94 is extended toward a direction which gets farther from the transfer space (S).

The first coupling portion 722 is formed in a shape which enables the slider body 721 located in an upper portion of the transfer space (S) to be coupled to the first guider 92 and the second coupling portion 723 is formed in a shape which enables the slider body 721 to be coupled to the second guider 94.

FIG. 5 illustrates that the first coupling portion 722 is projected from the bottom surface of the slider body 721 and bent toward the first guider 92 and that the second coupling portion 723 is projected from the bottom surface of the slider body and bent toward the second guider 94. Accordingly, the slider guiders 92 and 94 facilitate the slider body 721 to stably move along a direction parallel with the moving direction of the door body 51.

When the door body 51 is detachably provided in the slider body 721, the door coupling portion 727 is extended from the slider body 721 toward the door body 51 and includes a first rib 727*a* and a second rib 727*c* which are spaced a preset distance apart from each other along a height direction (Z-axis direction) of the slider body. The slider coupling portion 573 is inserted in a space between the first rib 727*a* and the second rib 727*c*.

The slider body 721 is moved to the rear portion of the transfer space (S) when the user pushes the door body 51 to the rear portion of the first storage compartment 11. The door body 51 located in the rear portion of the first space is moved to a front portion of the first storage compartment 11 when the elastic portion 73 supplies elasticity to the slider body 721. The transfer unit 7 is able to control the movement of the door body 51 by using the structure configured of the slider coupling portion 573 and the door coupling portion 727.

In some examples, the slider coupling portion 573 might be separated from the door coupling portion 727 in the transfer unit 7 having only the structure mentioned above, when the user pulls the door body 51 to the front portion of the first storage compartment 11. To prevent such a disadvantage, a hook 5731 bent toward the first rib 727*a* may be further provided in the slider coupling portion 573 and a second bent portion 727*d* bent toward a direction which gets farther from the slider body 721 may be further provided in the second rib.

In some examples, the second bent portion 727*d* is located at an acute angle with respect to the second rib, not located across the second rib at right angles. When the door body 51 needs cleaning or repairing, the door body 51 is able to be separated from the slider 72. To detach the door body 51 from the slider 72 of the transfer unit including the second bent portion 727*d* located across the second rib at right angles, the user has to lift the door body 51 in the Z-axis direction high enough for a free end of the hook 5731 not to interfere in a free end of the second bent portion 727*d*. However, unless a sufficient space is formed above the storage device P by the drawer or rack provided on the storage device P, it becomes difficult to detach the door body 51 and, in some examples, the second bent portion 727*d* forms an acute angle with respect to the second rib.

When the second bent portion 727*d* is located at such an acute angle with respect to the second rib 727*c*, the user rotates the door body 51 a little with respect to the hook 5731 and then pulls the door body 51 toward the front portion of the first space (X-axis direction), only to detach the door body 51 from the slider 72.

The first rib 727*a* may further include a first bent portion 727*b* having the same angle as the second bent portion 727*d* to restrict a rotation angle when the door body 51 is rotated with respect to the hook 5731.

To minimize the installation space of the storage device P, the storage device P has to be provided in the top surface of the partition wall 15 and the drawer or rack has to be provided over the partition wall 15. Accordingly, it is better to form smaller angles of the first bent portion and the second bent portion, only if the slider coupling portion 573 is separated from the door coupling portion 727 once the user pulls the door body 51 toward the first open surface.

The elastic portion 73 may be provided in any shapes capable of supplying the elasticity or restitution to return the door body 51 having opened the opening 41 toward the opening 41.

For example, one end of the elastic portion 73 is fixed to the transfer unit body 71 and the other end is provided as a tension spring fixed to the slider body 721. Alternatively, the spring may be a constant torque spring, a constant force spring or a spiral spring shown in FIG. 6.

Figure 7:
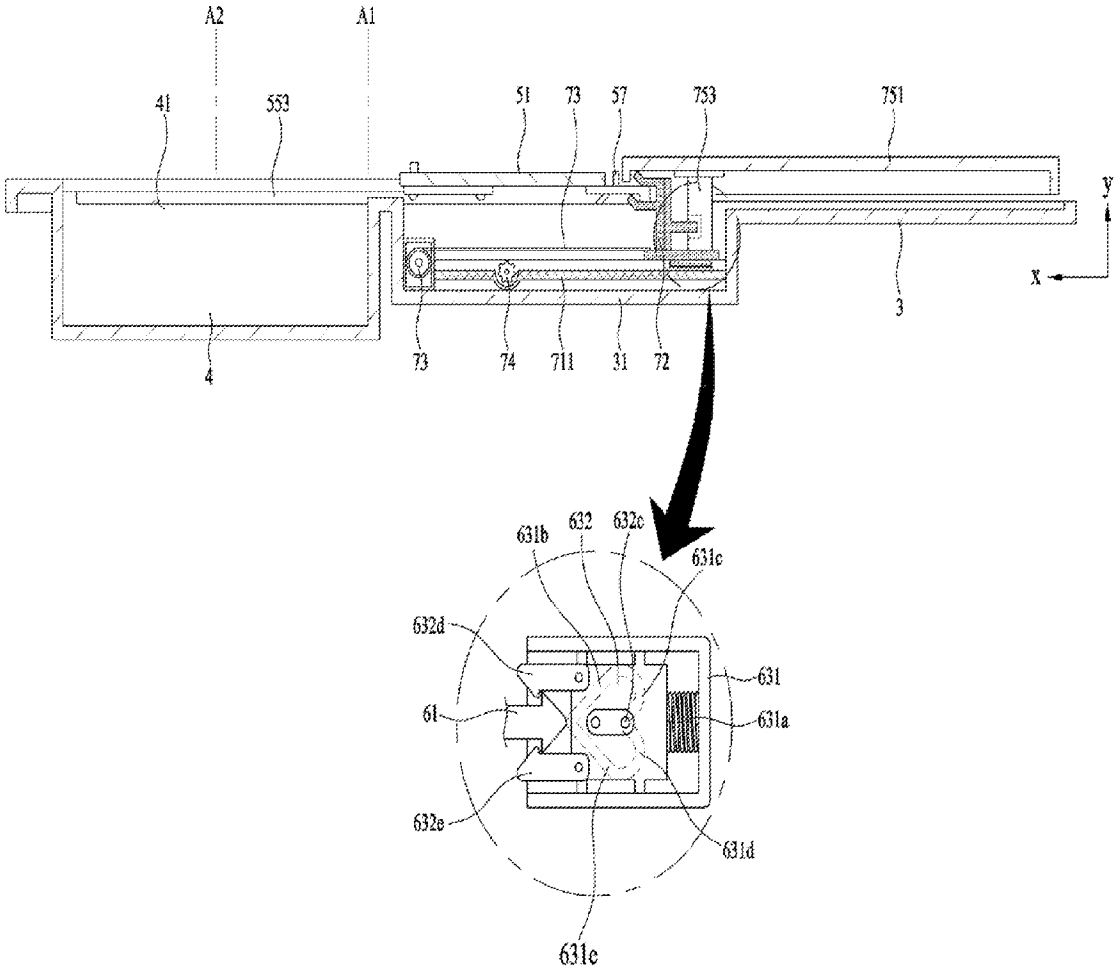
FIG. 7 is a sectional view illustrating an example state of the transfer unit when the accommodating unit door opens the accommodating unit.

The elastic portion 73 shown in FIG. 7 is configured to move the slider 72 toward the front portion of the transfer space (S) at an almost constant speed. The elastic portion 73 may include a spool 731 rotatably coupled to the transfer unit body 71 via a spool shaft 733, and a metal plate 735 having one end fixed to the spool 731 and the other end wound around the spool 731 to be fixed to the slider body 721.

In some examples, the speed control portion 74 may be provided in any types only if capable of decelerating the slider body 721 moving toward the front portion of the transfer space (S) (X-axis direction). As one example, the speed control portion 74 may be provided as a damper including a cylinder and a piston or a gear type shown in FIG. 5.

In the former case, the speed control portion 74 may include a cylinder fixed to the transfer unit body 71, a piston having one end disposed in the cylinder and a free end fixed to the slider body 721, and a head fixed to one end of the piston and located in the cylinder. In the speed control portion 74 having the structure mentioned above, the head will rub against an inner circumferential surface of the cylinder when the door body 51 is moved to close the opening 41, so as to prevent the speed of the door body 51 from increasing too much.

If too much elasticity or restitution is provided to the door body 51 by the elastic portion 73, the door body 51 moving to close the opening 41 might collide against the unit body 3 and damage and against the user's hand. The speed control portion 74 is provided to solve such problem.

The speed control portion 74 shown in FIG. 5 may be configured to be coupled to a rack gear 725 provided in the slider body 721. The rack gear 725 may be provided in a bottom surface of the slider body 721 to be located in the transfer space (S). For example, the rack gear 725 may be provided in a predetermined space 724 formed by the first and second coupling portions 722 and 723.

In some examples, the speed control portion 74 may include a gear 741 configured to be coupled to the rack gear 725, and a resistance supply unit for supplying resistance which interferes with the rotation of the gear.

The resistance supply unit may include a case fixed to the transfer unit body 71 and in which fluid is stored, a rotary body 743 penetrating the case and connecting the gear 741 and the rotary body 743.

The gear 741 may be coupled to the rack gear 725 between a point (A1, see FIG. 7) where the door body 51 starts to close the opening 41 and a point (A2) where it closes the opening 41 by 50%.

Supposing the drawer or rack is located on the storage device P, it is advantageous in an aspect of the opening 41 quick closing that the door body 51 is moved to A1 point. Even if the door body 51 is moved to A1 quickly, the problems caused by the rapid speed of the door body 51 mentioned above might not occur.

Accordingly, the gear 741 may be configured to be coupled to the rack gear 725 between a point where the door body 51 closes the opening by 50% and the point where it closes the opening 41 by 90%.

In some examples, the storage device P may further include a location fixing unit 6 for allowing the door body 51 to keep an open state of the opening 41.

Figure 6:
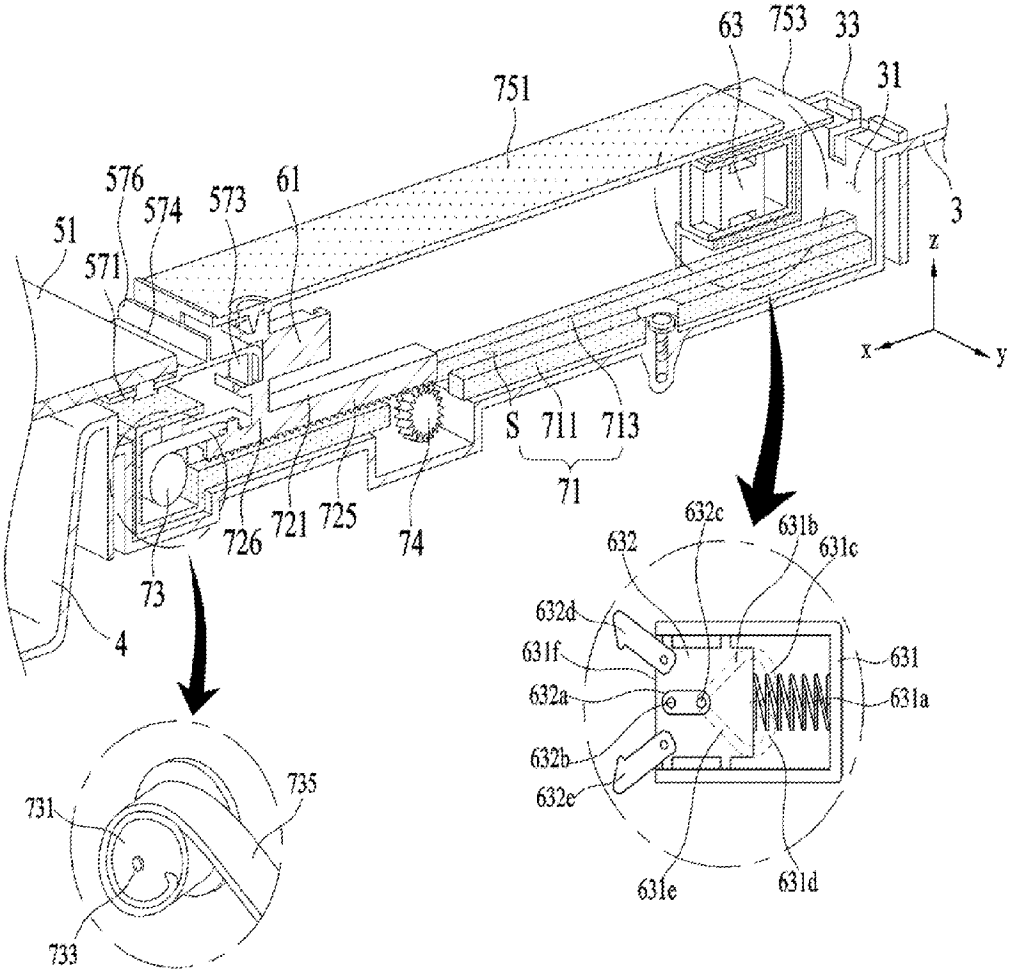
FIG. 6 is a perspective sectional view illustrating an example state of the transfer unit when the accommodating unit door closes the accommodating unit.

The location fixing unit 6 may include a coupling projection 61 fixed to the slider body 721 or the transfer unit body 71, and a decoupling portion 63 provided in the other one. In FIG. 6, the coupling projection 61 is provided in the slider body 721 and the decoupling portion 63 is provided in the transfer unit body 71.

The decoupling portion 63 repeats a coupled state (see FIG. 7) and a decoupled state (see FIG. 6) with respect to the coupling projection 61, whenever an external force is applied to the coupling projection 61.

As shown in FIG. 6, the decoupling portion 63 may include a decoupling first body 631 fixed to the transfer unit body 71, and a decoupling second body 632 configured to reciprocate in the decoupling first body 631 and having the coupling projection decoupled therefrom.

The decoupling first body 631 includes an insert hole 631*f* inserting the decoupling second body 632 therein, a spring 631*a* for supplying elasticity to the decoupling second body 632, and a plurality of paths 631*b*, 631*c*, 631*d* and 631*e* for providing passages of the moving decoupling second body 632.

The spring 631*a* may press the decoupling second body 632 toward the insert hole 61*f*.

A moving path of the decoupling second body may include a first path extended toward a bottom surface of the decoupling first body 631 from the insert hole 631*f*, a second path extended toward the insert hole 631*f* from one end of the first path, a third path 631*d* extended toward the bottom surface of the decoupling first body 631 from the second path, and a fourth path 631*e* connected to the other end of the first path.

In some examples, the decoupling second body 632 may include a bar 632*a* rotatably coupled to the decoupling second body via a shaft 632*b*, a projection 632*c* provided in the bar to be inserted in the moving paths 631*b*, 631*c*, 631*d* and 631*e*, and first and second bars which are rotatably to the decoupling first body 631 and exposed outside the decoupling first body 631 via the insert hole 631*f*.

When the door body 51 is moved to the rear portion of the first storage space 11 (X-axis direction), the coupling projection 61 is moved the decoupling second body 632 toward the bottom surface of the decoupling first body 631.

Once the decoupling second body 632 is pressed, the projection 632*c* is moved along the first path 631*b* and the second path 631*c* and located in the connecting point (the first point) between the second path 631*c* and the third path 631*d* and the first and second bars 632*d* and 632*e* are rotated toward the coupling projection 61 while interfered with by the insert hole 631*f*. Accordingly, when the projection 632*c* of the decoupling second body is located at the first point, the coupling projection 61 is in a state of being fixed to the decoupling second body 632 (see FIG. 7) and the door body 51 keeps the open state of the opening 41.

Hence, the user pushes the door body 51 toward the rear surface of the first storage space 11 in such a state again and the coupling projection 61 then presses the decoupling second body 632, so that the projection 632*c* may be moved to the connected point between the fourth path 631*e* and the first path 631*b* via the third path 631*d* and the fourth path 631*e* (see FIG. 6).

When the projection 632*c* provided in the decoupling second body is located at the second point, the coupling projection 61 is decoupled from the decoupling second body 632 and the slider body 721 is moved in X-axis direction by the elastic restoring force of the elastic portion 73. In this process, the door body 51 may close the opening 41.

Foreign substances are likely to come into the storage device P having the structure mentioned above. To prevent that, the storage device P may further include a cover 75 located in a top of the transfer unit accommodating groove 31.

The cover 75 is configured to move together with the slider 72. When the door body closes the opening 41, the cover 75 may be located in a top of the transfer unit accommodating groove 31.

As shown in FIG. 7, the cover 75 may include a cover body 751 located in the top of the transfer unit accommodating groove 31, and a cover support 753 fixed to the transfer unit body 71 and supporting the bottom surface of the cover body 751.

The cover body 751 is fixed to the slider 72 via a cover fixing portion 726 provided in the slider body. The cover support 753 is fixed to the transfer unit body 71 but not to the cover body 751. For example, the cover support 753 supports the cover body 751 configured to move together with the slider body 721. In some examples, the decoupling portion 63 of the location fixing unit may be fixed to the cover support 753.

To prevent the foreign substances falling to the transfer unit accommodating groove from the top from coming into the transfer unit accommodating groove 31, in some examples, the transfer unit accommodating groove 31 is located in a surface of the unit body 3 to which the cover body 751 is projected.

Figure 8:
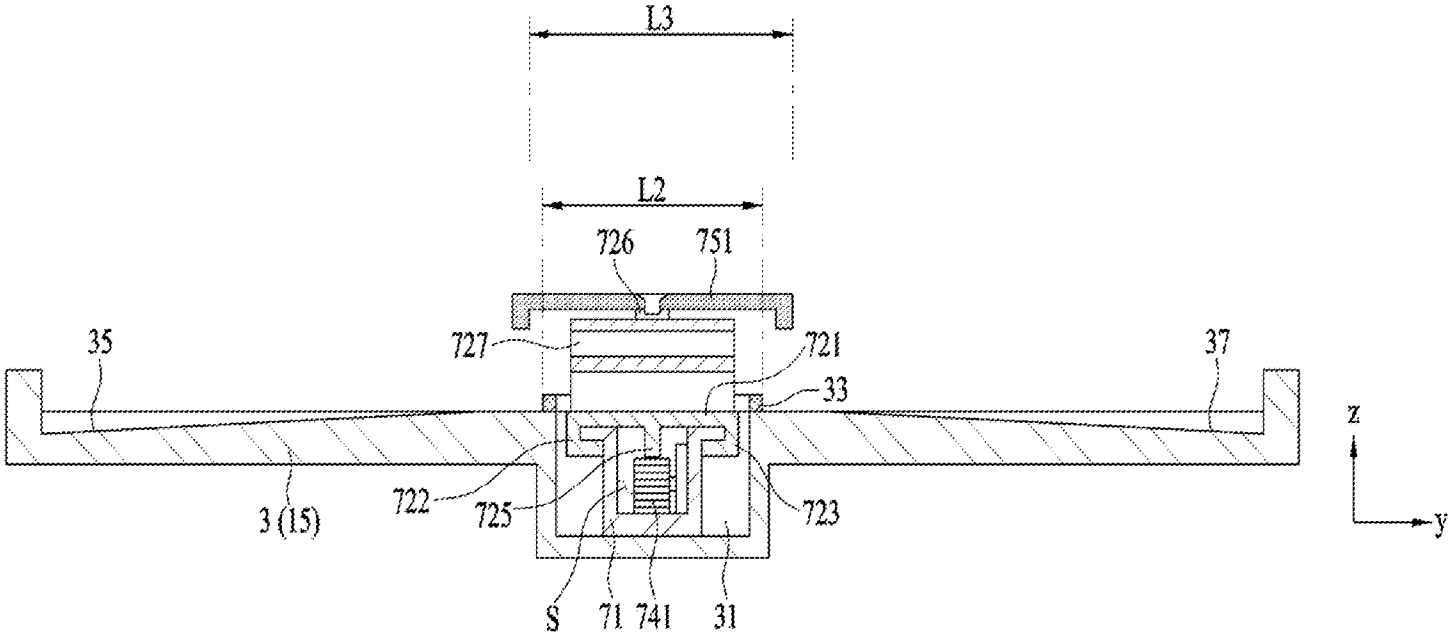
FIG. 8 is a sectional view illustrating an example partition wall and the transfer unit.

For example, as shown in FIG. 8, in case the center of the cover body 751 is equal to the center of the transfer unit accommodating groove 31, the width (L3, the Y-axis direction length of the cover body) of the cover body is larger than that of the cover body (the Y-axis direction length of transfer unit accommodating groove) and the length of the cover body (the X-axis direction length of the cover body) is larger than that of the transfer unit accommodating groove (the X-axis direction length of the transfer unit accommodating groove).

In some examples, to prevent foreign substances from coming into the transfer unit accommodating groove from the lateral surface of the transfer unit accommodating groove 31, a shut-off wall 33 may be further provided in the unit body 3 to surround an edge of the transfer unit accommodating groove 31. In some examples, the width L3 of the cover body is longer than the width L2 of the shut-off wall 33. The foreign substances which exist on a top of the cover body 751 have to fall outside the shut-off wall 33 so as to prevent the foreign substances from coming into the transfer unit accommodating groove 31.

Moreover, the unit body 3 may further include a first inclined surface 35 inclined downwardly to the edge of the unit body 3 from one of the lateral surfaces of the shut-off wall 33 in parallel with the moving direction (e.g., X-axis direction) of the door body 51, and a second inclined surface 37 inclined downwardly to the edge of the unit body 3 from the other one of the lateral surfaces.

As shown in FIG. 7, a connector 57 for connecting the door body 51 and the slider body 721 with each other may pass through the transfer unit accommodating groove 31, when the door body 51 is moved to open and close the opening 41. It is necessary to provide the connector 57 with a foreign-substance preventing portion for preventing foreign substances from coming into the transfer unit accommodating groove 31.

The foreign-substance preventing portion shown in FIG. 4 is located between the connector body 571 and the slider coupling portion 573 as a mechanism for moving the foreign substances such as liquid or solids falling to the connector 57 outside the transfer unit accommodating groove 31.

The foreign-substance preventing portion is located between the connector body 571 and the slider coupling portion 573 and it may include a drainage guider 577 provided along a width direction (e.g., Y-axis direction) of the transfer unit accommodating groove 31, and a connector inclined surface 574 and 575 provided between the connector body 571 and the drainage guider 577.

The width L1 of the drainage guider 577 may be larger than the width L2 of the transfer unit accommodating groove 31 and the width of the shut-off wall. The connector inclined surface may be configured to guide the foreign substances drawn between the connector body 571 and the drainage guider 577 outside the shut-off wall 33.

FIG. 4 illustrates that the connector inclined portion includes a first connector inclined surface 574 inclined downwardly toward one edge portion of the drainage guider 577 from the center of the drainage guider 577, and a second connector inclined surface 575 inclined downwardly toward the other edge portion of the drainage guider from the center of the drainage guider 577.

In some examples, in the storage device P having the structure mentioned above, the door body 51 is likely to fail to open and close the opening 41 or it is likely to take a strong force to move the door body 51, unless the distance where one lateral surface of the door body 51 in parallel with the moving direction of the accommodating unit door 5 is moved is equal to the distance where the other lateral surface of the door body 51 is moved.

To solve the problem that the door body 51 will shakes in moving along the top surface of the unit body 3, the storage device P may further include a guider 55 for guiding the movement of the door body 51.

The guider 55 may include a roller 551 rotatably coupled to the door body 51, and a roller accommodating groove 553 provided in the accommodating unit body 3 and providing a movement path of the roller 551. The roller accommodating groove 553 may be concavely curved from a surface of the accommodating unit body 3 and it has to be provided along a direction parallel with the moving direction of the accommodating unit door 5 (e.g., X-axis direction).

The guider 55 may be located under both ends of the door body 51 without affecting the transparent door body 51. For example, the user is able to see the internal space of the accommodating unit through the door body 51. For example, the guider 55 may not interfere with the view.

The guider 55 may only guide the back-and-forth movement of the door body 51, not providing elasticity or a damping force to the door body 51.

So far, the transfer unit 7 for guiding the back-and-forth movement of the door 5 and providing the door 5 with the elastic restoring force and/or damping force is described. The guider 55 for guiding the back-and-forth movement of the door is also described.

Hereinafter, implementations configured to prevent the door splaying and reduce the frictional resistance caused by the door twisting will be described in detail.

Repeated description about similar or equal configurations and components as the implementations mentioned above will be omitted.

The door may be made of transparent glass so that it might become relatively heavy. Accordingly, the vibration generated during the transporting process of the refrigerator might the door splaying only to damage the product and lower the product maturity disadvantageously.

In addition, frictional resistance might be generated by the door twisting caused by a difference between the left and right speeds of the door, because the door 5 might be pushed or pulled at a skewed point to the left or right, not the center point.

Figure 9:
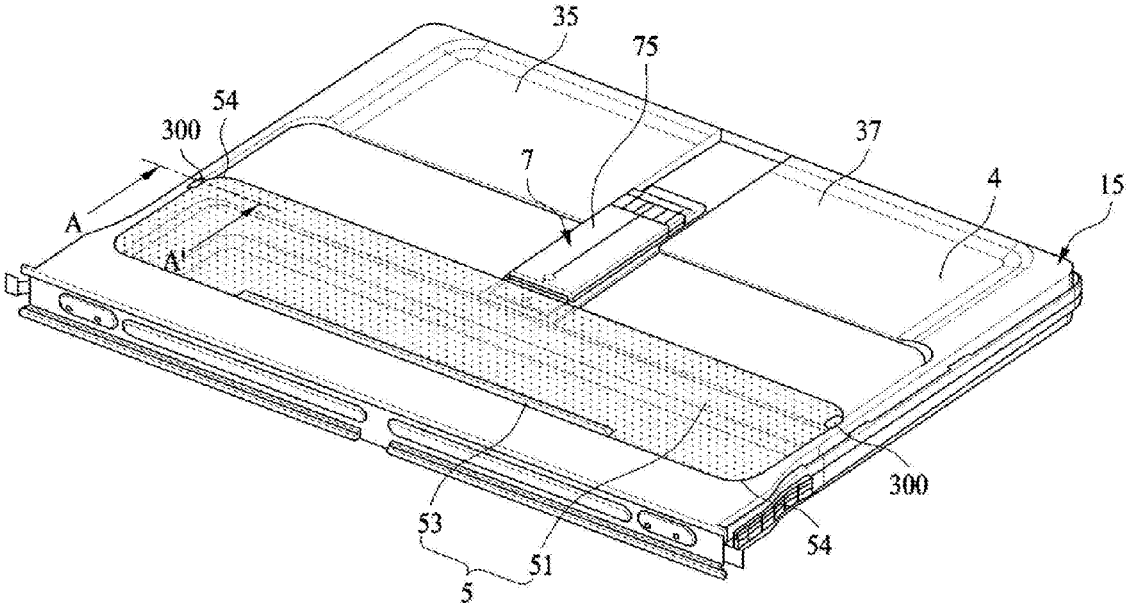
FIG. 9 is a perspective view illustrating another example storage device.

As shown in FIG. 9, in some examples, an upper rib 300 may prevent or restrict the upward movement or spraying of the door 5, and the upper ribs 300 may be provided in left and right sides of the door, respectively. Alternatively, the upper rib 300 may be formed in the partition wall 15 or the accommodating unit body 3.

The upper rib 300 is vertically extended from one side of the door 5 and then horizontally extended to left and right center of the door 5. For example, the upper rib 300 may include a vertical portion 300*a* vertically extended to form a gap with the top surface of the door, and a horizontal portion 300*b* horizontally extended from the vertical portion toward the center of the door to partially cover the top surface of the door. The upper rib 300 may have a predetermined height and a predetermined left-and-right width to allow the door 5 to be moved back and forth after inserted therein. However, in some examples, the back-and-forth length of the upper rib 300 is smaller than that of the door 5.

As mentioned above, the door 5 may be selectively coupled to the transfer unit 7. For example, the door 5 may be completely separated from the refrigerator so that it may not be easy to selectively couple or decouple the door 5, because of the upper rib 300.

Therefore, the gap between the door 5 and the upper rib 300, the shape of the door 5, and the location of the upper rib 300 are important.

The upper rib 300 may be configured to cover a rear portion of the door 5 in a state where the door 5 is closed. For example, the upper rib may be spaced apart forwardly from the rearmost end of the door 5.

The door 5 may be formed in a rectangular shape. For example, two corners of the rear end may have rounds 54. The door 5 may be formed in a plate shape and located horizontally in parallel with the top surface of the partition wall. In some examples, the upper rib 300 may be formed to partially cove the rounds 54. In some examples, the upper rib 300 is formed to cover a region transitioning from a linear portion of the lateral surface to the rounds 54. Accordingly, the upper rib 300 is located a predetermined direct overhead portion of the round in a state where the door is completely closed.

In case the user lifts and pulls the door 5, with holding the handle 53, the door 5 may get out from the upper rib 300. In reverse, the door may be inserted in the upper rib. That is because the rounds of the door 5 may be inserted in the upper rib 300 first.

Even in a state where the door is completely open, a front round of the door 5 and the upper rib 300 may be located equally. Accordingly, the upper rib 300 may partially cover the front rounded corner of the door 5 and the door can be closed very efficiently. That is because the rounded corner is inserted in the upper rib 300 first.

In some examples, the upper rib 300 covers both front sides of the door in a state where the door is completely open, so that the door will not be lifted upward. The door 5 may be held by the transfer unit 7. Accordingly, the door is not lifted. There may be at least three support points so as to prevent the upward movement of the door and the at least three support points may form a triangle, so that the problem of door lifting and damage may not occur even if vibration is generated during the transportation of the refrigerator.

When the user opens the door, a force for lifting the door may be applied to the handle 53. However, the upper rib 300 closes the upper portions of the door 5 so that the door 5 can be moved smoothly, without being limited.

Figure 10:
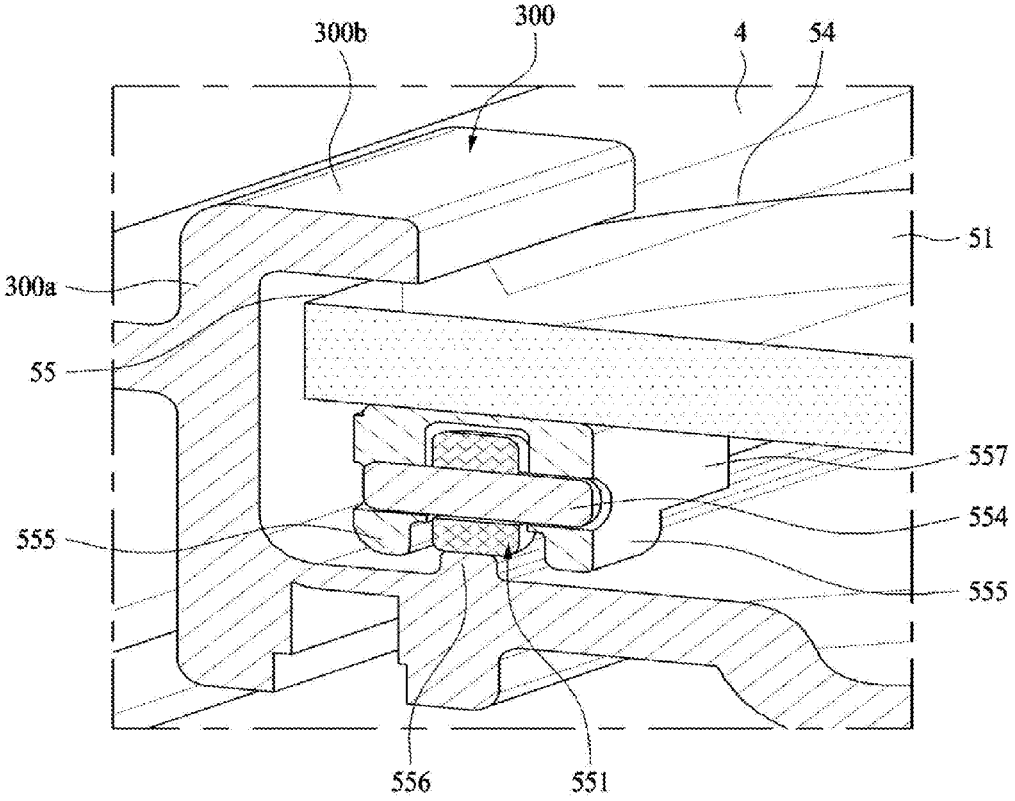
FIG. 10 is a sectional view taken along AA' of FIG. 9.

FIG. 10 is a sectional diagram along AA' of FIG. 9.

In the implementation mentioned above, the roller 551 is moved back and forth along the roller accommodating groove 553. For example, friction is generated between the bottom, left, and right surfaces of the roller 551 and the roller accommodating groove 553, which results in noise/frictional resistance when the door 5 is open.

In this implementation, a guide rib 555 may be provided to reduce the noise and frictional resistance and also reduce the friction caused by the twisting of the door 5. The guide rib 555 may be extended from the left and right surfaces past the bottom surface of the roller 551. The shaft 554 of the roller 551 may be connected to the guide rib 555.

The roller 551 may be mounted to a roller bracket 557 and the roller bracket 557 may be mounted to the bottom surface of the door 5. A rail rib 556 may be projected from a surface of the accommodating unit body upward longitudinally. The roller 551 may move back and forth, riding on the rail rib 556. For example, the door 5 is able to move back and forth while the bottom surface of the roller 551 contacts with the top surface of the rail rib 556, so that a frictional area can be reduced noticeably.

In some examples, the guide ribs 555 is provided in left and right portions of the rail rib 556. The guide rib 555 may be extended downwardly more than the top surface of the rail rib 556. For example, guide ribs 555 surrounds the rail rib in both sides of the rail rib 556. When the door 5 is twisted to one direction, one guide rib 555 may contact with the rail rib 556 to prevent the door from being twisted more. When the door is twisted to the other direction, the other guide rib 555 contacts with the rail rib 556 to prevent the door from being twisted more.

As shown in FIG. 10, there is a gap between the lateral surfaces and top surface of the door with the upper rib 300. In some examples, the door 5 may not contact with the upper rib 300 in normal using of the door 5. Only when the door is limited not in the normal use of the door 5, both of the door and the upper rib selectively contact with each other so as to prevent the door lifting and damage on them.

In some examples, the lateral surfaces of the door 5 may not contact the upper rib 300 or the accommodating unit body 3. In this case, the left and right gaps between the lateral surfaces of the door and the upper rib 300 and accommodating unit body 3 may be larger than the gap between the guide rib 555 and the roller 551.

Four rollers may be formed in left and right portions of the door, so that the door can slide stably. The guide rib 555 may be adjacent to the roller 551 and four guide ribs 555 may be provided. For example, the guide ribs may be longitudinally formed in a back-and-forth direction. Accordingly, when the door is twisted, the roller 551 may contact with the guide rib 555 before the lateral surfaces of the door contacts with the upper rib 300 or the accommodating unit body 3. Accordingly, the damage or twisting of the door can be prevented.

Figure 11:
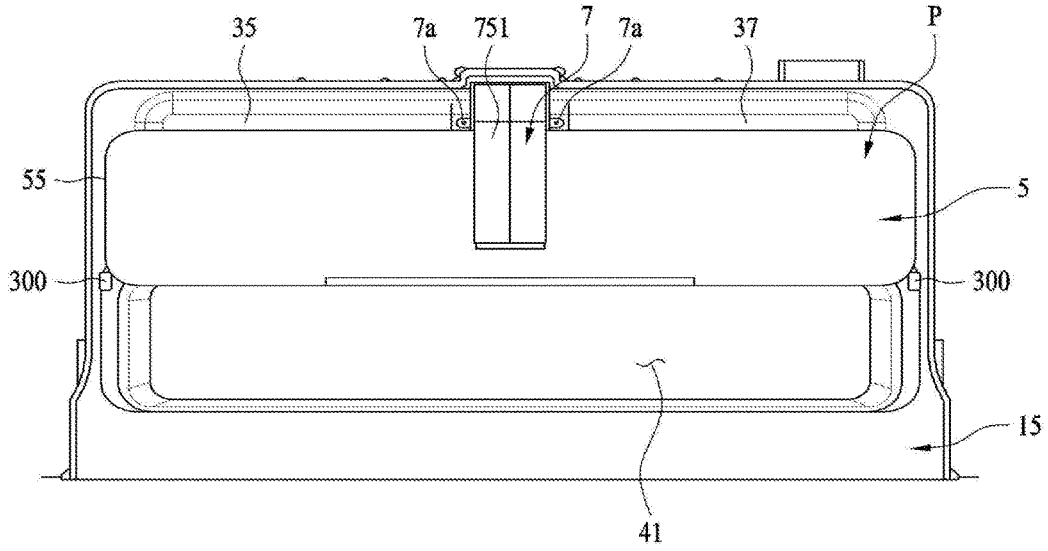
FIG. 11 is a view illustrating another example storage device.
Figure 12:
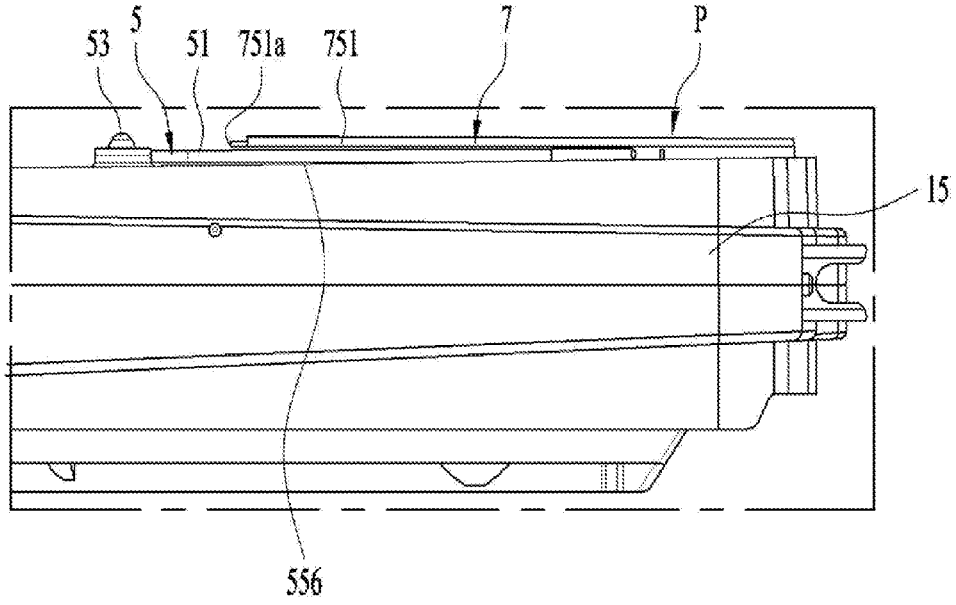
FIG. 12 is a side view illustrating the storage device shown in FIG. 11.

Hereinafter, referring to FIGS. 11 and 12, the storage device P will be described.

In the implementation described above, the door 5 and the cover body 651 of the transfer unit are configured to move back and forth together. In some examples, a sufficient space in which the cover body 751 is able to move backward is provided. For example, in case a back-and-forth width of the partition wall 15, or the depth of the storage compartment is large enough, a sufficient space or length in which the cover body 751 is able to move to the rear portion of the door 5 may be provided.

However, when the size of the refrigerator is small or an auxiliary space rather than the storage compartment is formed in the rear portion with respect to the partition wall 15, the back-and-forth depth of the storage compartment in which the storage device P is provided may be relatively small. For example, components for purifying water may be mounted to the rear portion of the storage compartment in a refrigerator having a purifier function and the space where the cover body 751 is able to move backward may be restricted.

In the present implementation, the cover body 751 may be fixed to the partition wall 15 or the accommodating unit body 3. For example, the cover body 751 may be fixed by using a coupling unit 7*a*. The coupling unit 7*a* may be provided in each side of the rear portion of the cover body 751. The coupling units 7*a* may determine the maximum length of the door 5 which is movable backward.

An open portion 751*a* for accommodating the door when the cover body 751 is moved backward may be further provided. The open portion 751*a* may be continuously formed to a front portion and both sides of the cover body 751. Accordingly, the door 5 may be inserted in a lower portion of the cover body 751 and get out of the cover body 751 via the open portion 751*a*.

Accordingly, the cover body 751 always covers the other components of the transfer unit 7 so as to protect the components of the transfer unit 7 and prevent foreign substances from coming into the transfer unit 7.

The coupling unit 7*a* may be located in the rear portion of the open portion 751*a*, and the inserted door 5 may not be hooked to the coupling unit 7*a*. The cover body 751 has a shape of which a front portion is up in the air with respect to the coupling unit 7*a*. The door 5 has to be inserted in the front portion which is up in the air, that is, the open portion 751*a*.

The shape or structure of such the cover body 751 allows the front portion of the cover body 751 to be deformed downwardly. For example, the door 5 might collide against the cover body 751 and the smooth inserting could become difficult.

To prevent that, the cover body 751 may have a gradient which rises upwardly toward the front portion. For example, the height of the open portion 751*a* is the maximum value in the front portion of the cover body 751 and gets smaller toward the rear portion. Accordingly, the door 5 may be inserted in the cover body 751 smoothly in an initial stage. The upward gradient may decrease the downward deformation. Even if the downward deformation is generated, the door inserting may be performed smoothly.

In some implementations, not only the gradient of the cover body 751 but also a gradient is provided to a sliding portion of the door. For example, the door 5 may have a gradient and move back and forth.

As mentioned above, the door 5 is supported to the partition wall 15 or the accommodating unit body 3 by the roller 551 so as to slide back and forth. For example, the door may be supported to the roller accommodating groove or the roller guide rib.

In some examples, the roller accommodating groove 553 or the roller guide rib 555 may have a back-and-forth gradient. The gradient may be formed so that the front region of the open portion 751*a*, that is, a region of the open portion 751*a* before the door 5 is inserted may be the lowest and becomes higher.

The door 5 is able to come into the cover body 751 through the gradient. For example, the height of the open portion 751*a* may be increased more in the front region of the open portion 751*a*. That may bring an effect of increasing the height of the insert hole in which the door is inserted.

Accordingly, the problem of failure to close the door 5 smoothly which might be caused by the interference between the door and the cover body 751 may be prevented even if a long period of use increases.

According to the implementations mentioned above, the basket with the beautiful design and the sub storage compartment including the same may be realized. Also, the user is able to manipulate the moving basket smoothly. Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet defining a first storage compartment and a second storage compartment vertically below the first storage compartment;

a partition wall partitioning the cabinet into the first storage compartment and the second storage compartment, the partition wall having a horizontal top surface;

an accommodating unit defining an accommodating space and an opening, the accommodating space being recessed downward from the horizontal top surface of the partition wall, and the opening being located at an upper portion of the accommodating unit and being configured to introduce food therethrough;

an accommodating unit door located at the upper portion of the accommodating unit and configured to open and close the opening by moving in a direction parallel to the horizontal top surface of the partition wall;

a roller located below the accommodating unit door, the roller supporting the accommodating unit door and allowing the accommodating unit door to slidingly move with respect to the partition wall; and an upper rib provided at each of left and right portions of the accommodating unit door and configured to restrict splaying of the accommodating unit door, wherein the upper rib is located in the partition wall and spaced apart from a lateral side surface and a top surface of the accommodating unit door, wherein the partition wall includes a rail rib that protrudes upward and that contacts and supports the roller, wherein the refrigerator further comprises a guide rib extending downward from left and right portions of the roller and surrounding both sides of the rail rib, wherein the rail rib is spaced apart from the guide rib by a predetermined distance in a width direction, and wherein the predetermined distance is less than a distance between the lateral side surface of the accommodating unit door and the upper rib in the width direction.

2. The refrigerator of claim 1, wherein a length of the upper rib is shorter than a side length of the accommodating unit door.

3. The refrigerator of claim 2, wherein the accommodating unit door has a rectangular plate shape including straight sides and round corners.

4. The refrigerator of claim 3, wherein the accommodating unit door includes transition portions between the straight sides and the round corners, respectively, and wherein the upper rib is configured to cover at least one of the transition portions based on the accommodating unit door closing the opening.

5. The refrigerator of claim 1, wherein the roller includes a first pair of rollers located at the left portion of the accommodating unit door and a second pair of rollers located at the right portion of the accommodating unit door, and wherein the guide rib includes a first pair of guide ribs located at the left portion of the accommodating unit door and a second pair of guide ribs located at the right portion of the accommodating unit door.

6. The refrigerator of claim 1, further comprising a transfer unit located at the partition wall, the transfer unit including an elastic portion configured to provide elasticity to the accommodating unit door based on the accommodating unit door moving to open the opening of the accommodating unit.

7. The refrigerator of claim 6, wherein the transfer unit further includes a speed control portion configured to decelerate movement of the accommodating unit door based on the accommodating unit door moving to close the opening of the accommodating unit.

8. The refrigerator of claim 6, wherein the transfer unit further includes:

a transfer unit body being coupled to the partition wall and defining a transfer space extending in a direction parallel to movement of the accommodating unit door; and a slider movably provided in the transfer space and coupled to the accommodating unit door, and wherein the elastic portion includes a first end connected to the transfer unit body and a second end connected to the slider.

9. The refrigerator of claim 8, wherein the transfer unit is located rearward of a center portion of the accommodating unit door.

10. The refrigerator of claim 9, further comprising:

a transfer unit accommodating groove that is defined at the top surface of the partition wall and that receives the transfer unit; and a cover that is located vertically above the transfer unit accommodating groove and that protects the transfer unit accommodating groove from foreign substances.

11. The refrigerator of claim 10, wherein the cover is configured to move together with the accommodating unit door in rearward and forward directions.

12. The refrigerator of claim 11, wherein the cover is coupled to the slider and configured to move together with the slider based on the accommodating unit door moving forward to close the opening.

13. The refrigerator of claim 10, wherein the cover is fixed to the partition wall and allows relative movement of the accommodating unit door with respect to the cover.

14. The refrigerator of claim 13, wherein the cover comprises:

a pair of coupling portions located at rear left and right portions of the cover, respectively; and an open portion located forward of the pair of coupling portions and configured to receive the accommodating unit door between the partition wall and a lower surface of the cover based on the accommodating unit door moving rearward to open the opening.

15. The refrigerator of claim 14, wherein the cover slopes upward with respect to the top horizontal surface of the partition wall toward a front portion of the cover, and wherein a distance between the top horizontal surface of the partition wall and the lower surface of the cover is greater at the front portion of the cover than at a rear portion of the cover.

16. The refrigerator of claim 14, wherein the accommodating unit door includes an upper surface configured to slidingly contact the lower surface of the cover based on the accommodating unit door moving toward a rear portion of the cover, and wherein the upper surface of the accommodating unit door slopes upward toward the rear portion of the cover with respect to the top horizontal surface of the partition wall.

17. A refrigerator comprising:

a cabinet defining a first storage compartment and a second storage compartment vertically below the first storage compartment;

a partition wall partitioning the cabinet into the first storage compartment and the second storage compartment, the partition wall having a horizontal top surface;

an accommodating unit defining an accommodating space and an opening, the accommodating space being recessed downward from the horizontal top surface of the partition wall, and the opening being located at an upper portion of the accommodating unit and being configured to introduce food therethrough;

an accommodating unit door located at the upper portion of the accommodating unit and configured to open and close the opening by moving in a direction parallel to the horizontal top surface of the partition wall;

a roller located below the accommodating unit door, the roller supporting the accommodating unit door and allowing the accommodating unit door to slidingly move with respect to the partition wall; and an upper rib provided at each of left and right portions of the accommodating unit door and configured to restrict splaying of the accommodating unit door, wherein the upper rib is located in the partition wall and spaced apart from a lateral side surface and a top surface of the accommodating unit door, wherein the partition wall includes a rail rib that protrudes upward and that contacts and supports the roller, wherein the refrigerator further comprises a transfer unit located at the partition wall, the transfer unit including an elastic portion configured to provide elasticity to the accommodating unit door based on the accommodating unit door moving to open the opening of the accommodating unit, wherein the transfer unit further includes:

a transfer unit body being coupled to the partition wall and defining a transfer space extending in a direction parallel to movement of the accommodating unit door, and a slider movably provided in the transfer space and coupled to the accommodating unit door, and wherein the elastic portion includes a first end connected to the transfer unit body and a second end connected to the slider.

18. The refrigerator of claim 17, wherein the transfer unit is located rearward of a center portion of the accommodating unit door.

19. The refrigerator of claim 18, further comprising:

a transfer unit accommodating groove that is defined at the top surface of the partition wall and that receives the transfer unit; and a cover that is located vertically above the transfer unit accommodating groove and that protects the transfer unit accommodating groove from foreign substances.

20. The refrigerator of claim 19, wherein the cover is configured to move together with the accommodating unit door in rearward and forward directions.

21. The refrigerator of claim 19, wherein the cover is fixed to the partition wall and allows relative movement of the accommodating unit door with respect to the cover.

22. The refrigerator of claim 21, wherein the cover comprises:

a pair of coupling portions located at rear left and right portions of the cover, respectively; and an open portion located forward of the pair of coupling portions and configured to receive the accommodating unit door between the partition wall and a lower surface of the cover based on the accommodating unit door moving rearward to open the opening.

23. The refrigerator of claim 22, wherein the cover slopes upward with respect to the top horizontal surface of the partition wall toward a front portion of the cover, and wherein a distance between the top horizontal surface of the partition wall and the lower surface of the cover is greater at the front portion of the cover than at a rear portion of the cover.

24. The refrigerator of claim 22, wherein the accommodating unit door includes an upper surface configured to slidingly contact the lower surface of the cover based on the accommodating unit door moving toward a rear portion of the cover, and wherein the upper surface of the accommodating unit door slopes upward toward the rear portion of the cover with respect to the top horizontal surface of the partition wall.

* * * * *